US005317975A

United States Patent [19]

Sauvestre et al.

[11] Patent Number: 5,317,975

[45] Date of Patent: Jun. 7, 1994

[54] DEVICE FOR EJECTING PAYLOAD ELEMENTS FROM THE CASING OF A CARRIER SHELL

[75] Inventors: Gérard Sauvestre; Philip Fouqueau; Régis Aumasson; Dominique Dion; Christophe Arches, all of Bourges, France

[73] Assignee: Giat Industries, Versailles Cedex, France

[21] Appl. No.: 972,847

[22] Filed: Nov. 6, 1992

[30] Foreign Application Priority Data

Nov. 6, 1991 [FR] France ..... 91 13674

[51] Int. Cl.[5] ..... F42B 12/58

[52] U.S. Cl. ..... 102/489; 102/357

[58] Field of Search ..... 102/340, 342, 351, 357, 102/393, 489, 505

[56] References Cited

U.S. PATENT DOCUMENTS 3,981,244 9/1976 Adimari et al. ..... 102/489
4,226,185 10/1980 Tobler et al. ..... 102/357
4,621,579 11/1986 Badura et al. ..... 102/357
4,754,706 7/1988 Fauvel et al. ..... 102/489
5,210,372 5/1993 Tripptrap et al. ..... 102/489

FOREIGN PATENT DOCUMENTS 0395456 10/1990 European Pat. Off. .
2363077 3/1978 France .

*Primary Examiner*—Harold J. Tudor
*Attorney, Agent, or Firm*—Oliff & Berridge

[57] ABSTRACT

The technical field of the invention relates to devices providing for the ejection of a plurality of payload elements from the casing of a carrier shell. The ejection device according to the invention includes a pyrotechnic composition placed in a head and intended to create, after ignition, a gas pressure that pushes a piston over a short distance so as to displace towards a base a moving assemblage having a pusher plate and payload elements, and to eject the base, the piston then being stopped relative to the head and having an orifice which allows the gases to pass towards the moving assemblage so as to push the latter. The device includes braking means disposed between at least a part of the moving assemblage and the shell casing. This invention is applicable to mine-dispersing carrier shells.

16 Claims, 6 Drawing Sheets

DEVICE FOR EJECTING PAYLOAD ELEMENTS FROM THE CASING OF A CARRIER SHELL

BACKGROUND OF THE INVENTION

The field of this invention is that of devices providing for the ejection of a plurality of payload elements from the casing of a carrier shell.

Carrier shells are projectiles intended to transport a payload, then release it at a point in their trajectory.

The payload often contains a stack of several payload elements, for example submunitions.

French patent FR 2,363,077 describes one such type of carrier shell which contains a casing closed at one of its ends by a base and at the other by a head. A gas-generating pyrotechnic composition is placed inside the head, where it is ignited by a timer fuze to create gas pressure which acts on a piston. The thrust exerted by the piston on the stack of submunitions causes separation of the base and casing of the projectile, then ejection of the submunitions from the casing.

When a shell must eject a plurality of elements from its casing in this manner, the problem arises of collisions among these various elements after ejection.

Such collisions can lead to premature detonation in cases where the payload consists of submunitions. They can also result in disruptions in the trajectory of the payload elements, for example, by disrupting the opening of braking parachutes.

To prevent such collisions, French patent FR 2,363,077 proposes to create a piston which, under the action of gas pressure, can move towards the rear, pushing the payload elements, over only a short distance, the distance nevertheless being sufficient to shear off the screw thread connecting the casing and the base, and then to eject the base.

After ejection of the base, the piston is immobilized by a shoulder on the casing. However, the piston has an orifice which allows the gases of the ejecting pyrotechnic composition to pass towards the payload elements, which are thereby pushed towards the rear of the projectile after the piston stops.

The ejection velocity of the payload elements is reduced because of reduction in gas pressure produced by the orifice, and it is possible to regulate this velocity by adjusting the diameter of the orifice.

The principal disadvantage of such a device is that, in practice, it is not possible to control the ejection velocity of the payload elements, since ignition of the ejecting pyrotechnic composition violently pushes the piston, the stack of submunitions, and the base so that the latter can be ejected.

The energy transmitted is such that, in practice, although the piston is halted by the shoulder of the casing, the stack of submunitions continues on its way and is ultimately ejected from the shell at a velocity little different from the ejection velocity of the base.

SUMMARY OF THE INVENTION

An object of this invention is to remedy this disadvantage by providing an ejection device with which the velocity at which the payload elements are ejected from the casing of the carrier shell can in fact be controlled. By providing for ejection of the payload elements at a reduced velocity, the invention also makes it possible to produce dispersion of the latter, and to avoid any risk of collision among them.

The present invention provides a device for ejecting a plurality of payload elements, for example, submunitions, from the casing of a carrier shell, and comprises a pyrotechnic composition placed in a head and intended to create, after ignition, a gas pressure that pushes a piston over a short distance so as to displace towards a base a moving assemblage comprising a pusher plate and the payload elements, and to eject the base, the piston then being stopped relative to the head and having an orifice which allows the gases to pass towards the moving assemblage so as to push the latter, the device including braking means disposed between at least a part of the moving assemblage and the shell casing.

With such an arrangement, it is possible to control the ejection velocity of the payload elements and, in particular, to prevent abrupt ejection of the assemblage of payload elements following the base.

BRIEF DESCRIPTION OF THE DRAWINGS

The invention will be better understood after reading the description below of several embodiments, given with reference to the attached drawings in which.

DETAILED DESCRIPTION OF PREFERRED EMBODIMENTS

According to a first embodiment of the present invention, the braking means are coupled to at least one element of the payload. In particular, the braking means can be coupled to the element of the payload that is closest to the base.

According to another embodiment, the braking means is coupled to the pusher plate.

According to one particular embodiment, the braking means comprises at least one strip of flexible material placed in a peripheral groove provided on the payload element and/or the pusher plate, the strip having undulations whose amplitude is such that they project from the groove so as to contact the inside surface of the casing of the shell.

Preferably, the ejection device comprises means providing an axial attachment inside the casing between the various components of the moving assemblage.

The axial attachment means can comprise at least one key having a profile that interacts with complementary profiles provided on the elements in question, the key also providing for said elements to rotate together.

According to other characteristics of the invention:

The pusher plate has a contact surface for a part of the piston, located in the vicinity of the axis of the latter;

The piston has a peripheral shoulder intended to come to rest against a stop surface integral with the head; and shock absorption means having a deformable annular spring ring are placed between the shoulder and the stop surface;

The orifice is placed substantially on the axis of the piston, and opens, on the pyrotechnic composition side, at a protrusion having radial channels or furrows which communicate with it.

Figure 1:
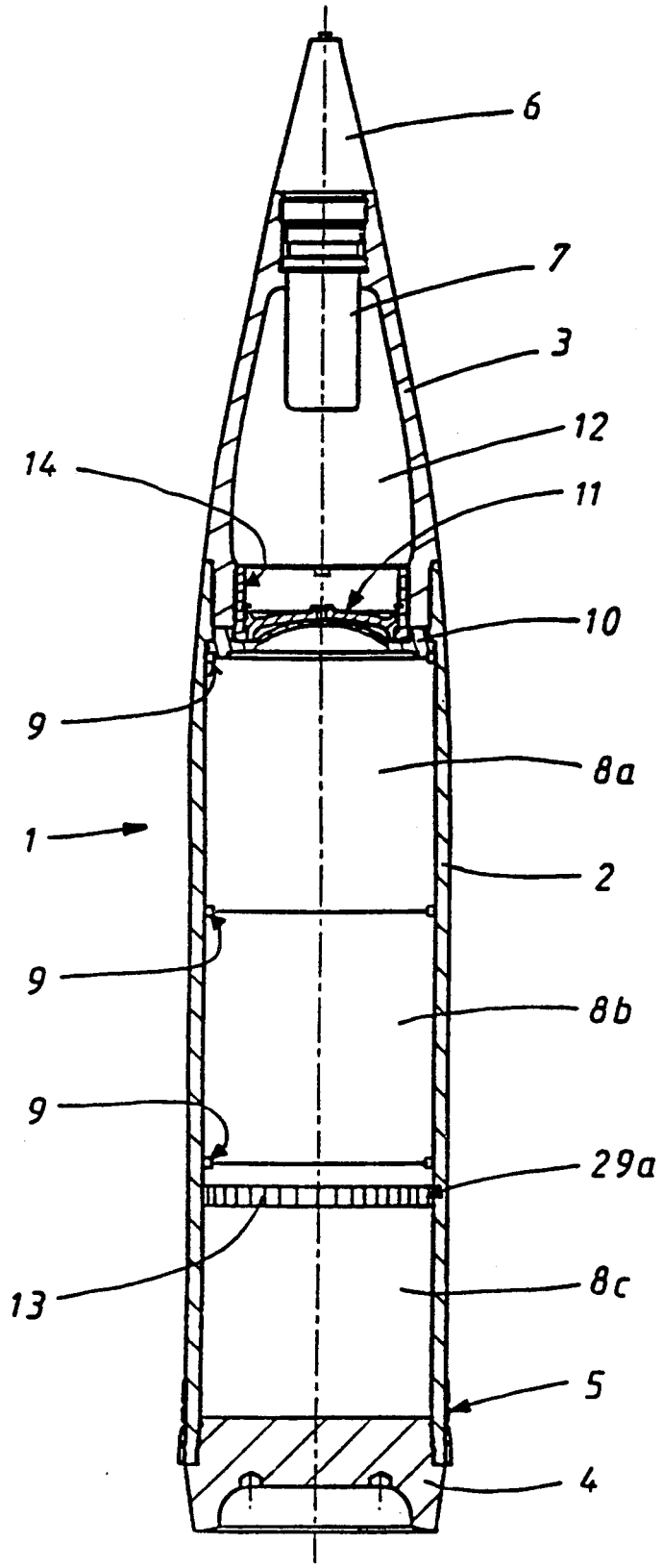
FIG. 1 is a schematic axial sectioned view of a carrier shell equipped with an ejection device according to the invention.

Referring to FIG. 1, a carrier shell 1 comprises a steel casing 2 having at its front part a head 3 and at its rear part a base 4. Head and base are coupled to the casing by means of screw threads. Casing 2 also has at its rear end a band 5, made, for example, of copper, fastened by welding at a peripheral groove of the casing.

Head 3 has a mechanical or electronic timer fuze which is intended to ignite, in flight and upon expiration of a programmed time, a gas-generating pyrotechnic composition contained in a known manner in a housing, for example, made of metal.

The pressure generated by the gases develops in a cavity 12 inside the head and defined by a piston 11. The piston presses against a pusher plate 10 which in turn is in contact with a first payload element 8*a*.

In this instance casing 2 contains three payload elements 8*a*, 8*b*, and 8*c* which are, for example, dispersible mines.

Pusher plate 10 and the three payload elements 8*a*, 8*b*, and 8*c* constitute a moving assemblage which is displaced relative to casing 2 of the carrier shell under the action of the gas pressure generated by pyrotechnic composition 7, as will be described below.

Figure 2:
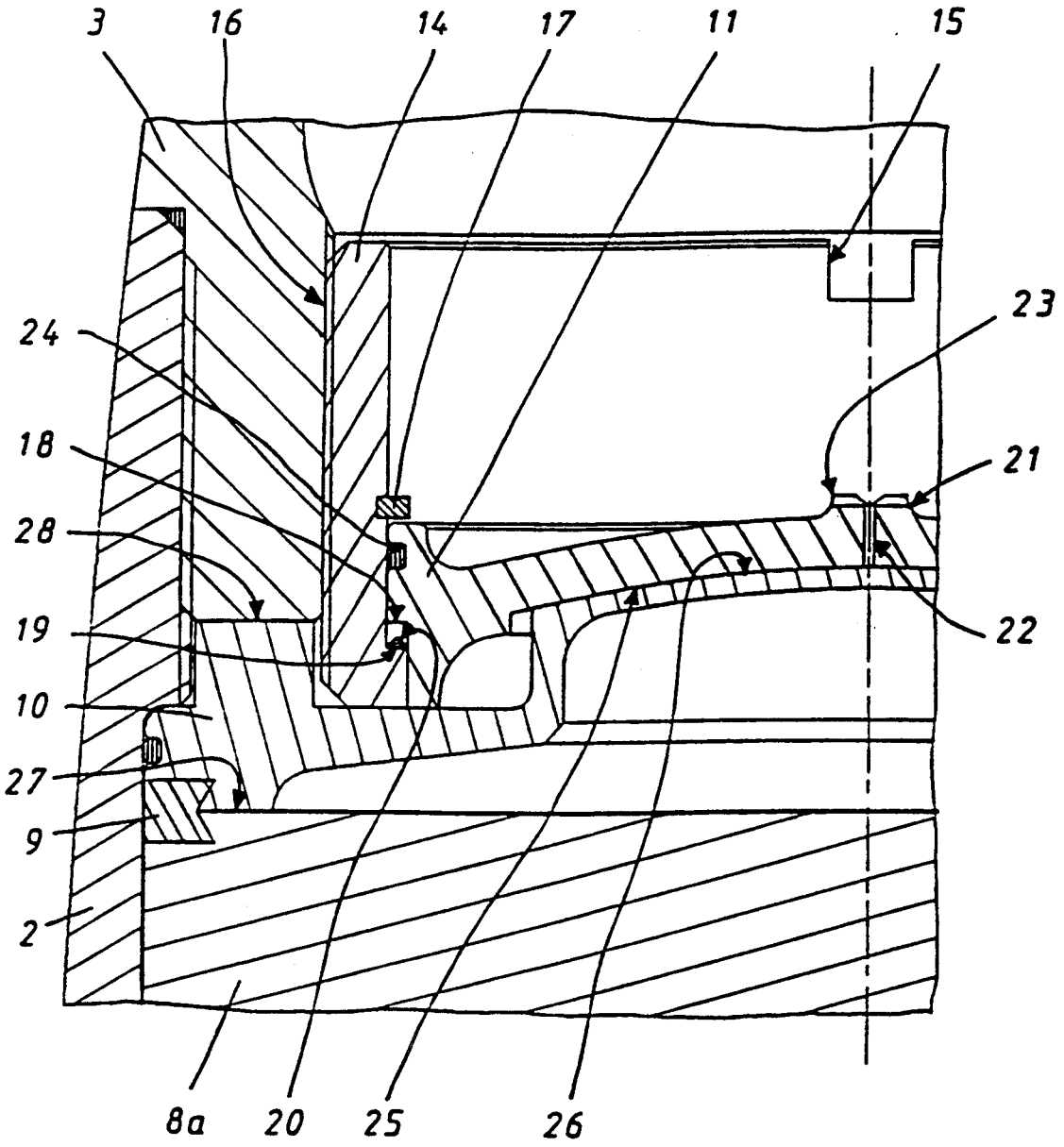
FIG. 2 is a partial, enlarged view of the ejection device.

The various payload elements are caused to rotate together with the casing by means of head 3 which has lugs, not depicted here, disposed on its front face 28 (see FIG. 2).

These lugs drive pusher plate 10. The latter in turn drives element 8*a* by means of two keys 9 placed symmetrically with respect to one another relative to the axis of the shell.

The other payload elements 8*b* and 8*c* are also spun by keys 9.

Referring to FIG. 2, which shows in detail the ejection device according to the invention, it can be seen that head 3 has a tapped thread on which is installed a collar 14. Said collar is intended to produce axial locking of the payload elements in the body of the carrier shell, and for that purpose it has notches 15 with which it can be rotated relative to the head, through the fuze receptacle and by means of an appropriate tool.

After tightening, collar 14 rests on pusher plate 10, which in turn rests on first payload element 8*a*.

Piston 11 is mounted slidably with respect to said collar 14, and is immobilized axially on the one hand because it rests on pusher plate 10, and on the other by a stop ring 17 placed in a cylindrical groove of collar 14.

The piston has an O-ring 24 placed in an annular groove of its outside cylindrical surface. The O-ring is intended to provide sealing at this point against the gases of pyrotechnic composition 7.

The piston has on its upper face a protrusion 21 at which a substantially cylindrical orifice 22 opens. Orifice 22 is placed substantially on the axis of the piston, and passes through it from one side to the other; its diameter is on the order of a few millimeters.

The protrusion also has four radial furrows 23 with a V-shaped profile, which communicate with orifice 22.

The function of these furrows will be explained later on.

The piston also has a peripheral shoulder 18 intended to come to rest, as the pressure increases, against a stop surface 19 disposed on collar 14.

A deformable annular spring ring 20, made in this case of copper and with a substantially triangular section, constitutes a means of absorbing the shock between piston 11 and pusher plate 10.

Pusher plate 10 has an outside diameter substantially equal to the inside diameter of the shell casing, and also has at its periphery an O-ring which provides sealing against the gases generated by the pyrotechnic composition.

It possesses an annular surface 27 which is in contact with element 8*a* and a substantially spherical contact surface 26 which is in contact with a complementary surface 25 of piston 11 located in the vicinity of the axis of the latter. The contact surface 26 also blocks off orifice 22.

Contact surface 26 makes it possible to enhance the mechanical strength of piston 11 as the pressure increases, and thus allow displacement thereof up to its stop surface 19 without deformation or jamming.

Pusher plate 10 also has notches (not depicted) intended to engage with complementary lugs present on the head at the front face 28 thereof, so as to ensure that these elements rotate together when the shell is fired.

Lastly, pusher plate 10 rotates together with first payload element 8*a* by means of keys 9.

Figure 4A:
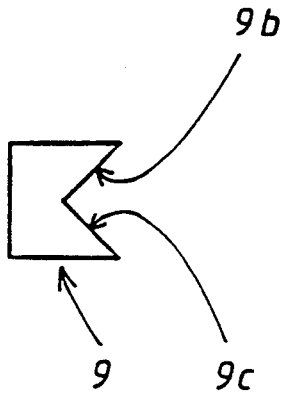
FIGS. 4*a*, 4*b*, and 4*c* depict an attachment key in three orthogonal views.
Figure 4B:
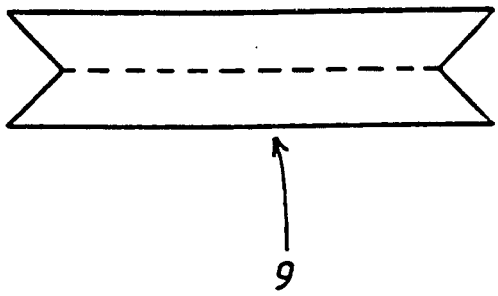
Figure 4C:
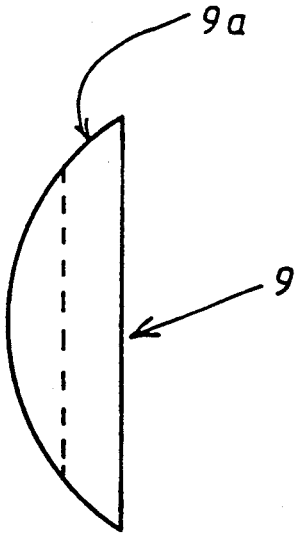

One of these keys is depicted in three orthogonal views in FIGS. 4*a*, 4*b*, and 4*c*.

Each key has a cylindrical surface portion 9*a*, the diameter of which is substantially equal to the inside diameter of the shell casing, as well as a profile containing two orthogonal plane portions 9*b* and 9*c* produced by milling.

Figure 5A:
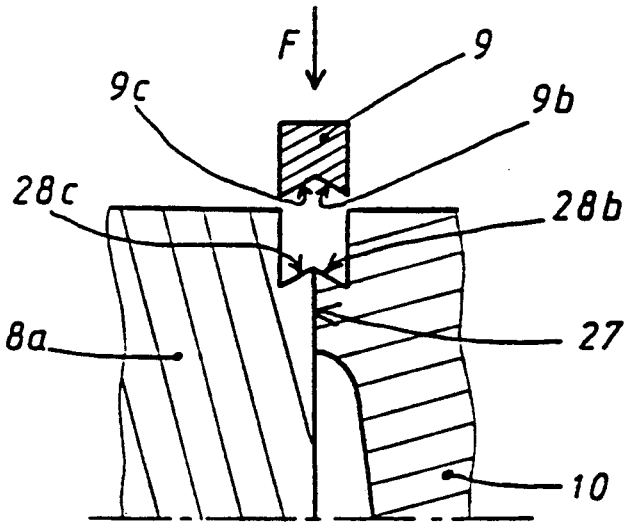
FIG. 5*a* shows, in transverse section, two payload elements assembled by means of an attachment key.
Figure 5B:
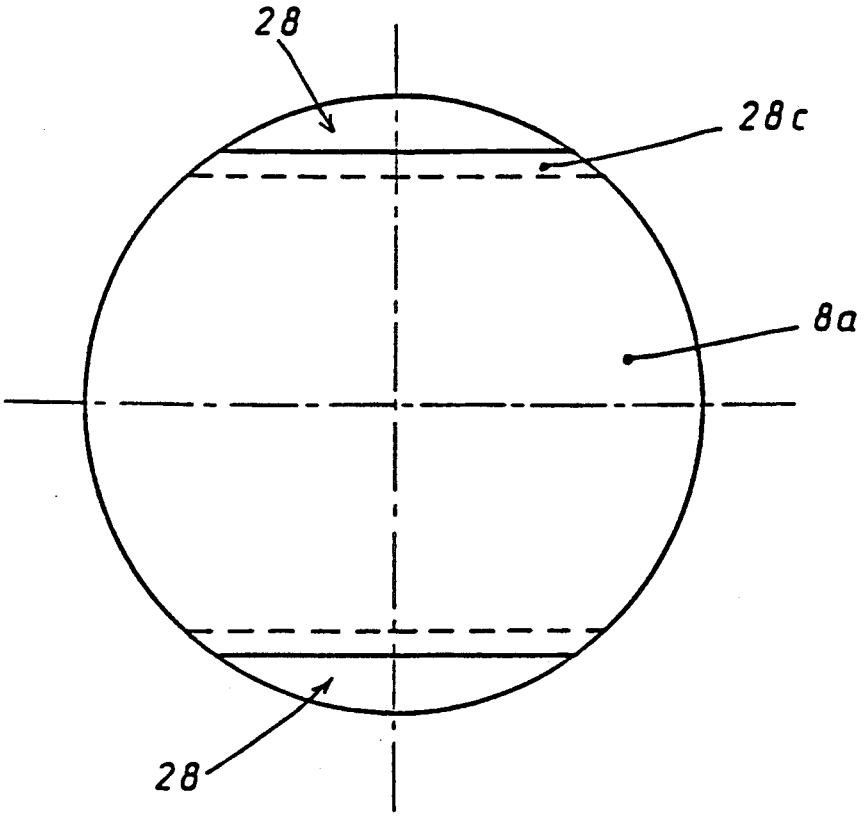
FIG. 5*b* is a front view of a payload element showing the key receptacles.

Referring now to FIGS. 5*a* and 5*b*, key 9 is installed along a direction F in a receptacle located partly on element 8*a* and partly on pusher plate 10.

The various parts of the receptacle are produced on element 8*a* and pusher plate 10 by means of a shaping milling cutter.

Receptacle 28, produced by bringing element 8*a* and plate 10 together, contains a plane portion 28*c* present on element 8*a* and a plane portion 28*b* present on pusher plate 10.

The profile of the receptacle is thus complementary to that of key 9, plane 9*c* coming in contact with plate 28*c*, and plane 9*b* in contact with plane 28*b*.

The advantage of this type of configuration is that key 9 causes pusher plate 10 and payload element 8*a* both to rotate and to be displaced together. Two keys are placed symmetrically to one another with respect to the axis of the pusher plate (in other words, the axis of the shell) (see FIG. 5*b*).

Keys 9 are placed in identical receptacles between payload elements 8*a* and 8*b*, and between elements 8*b* and 8*c*.

Thus, when the payload is ejected, the moving assemblage containing the pusher plate and the payload elements is pushed as a single unit by the gas pressure. The advantage of this arrangement will be shown below.

Referring to FIG. 1, payload element 8*c* has a peripheral groove 29*a* in which is placed a braking element containing a flexible strip 13.

Figure 3A:
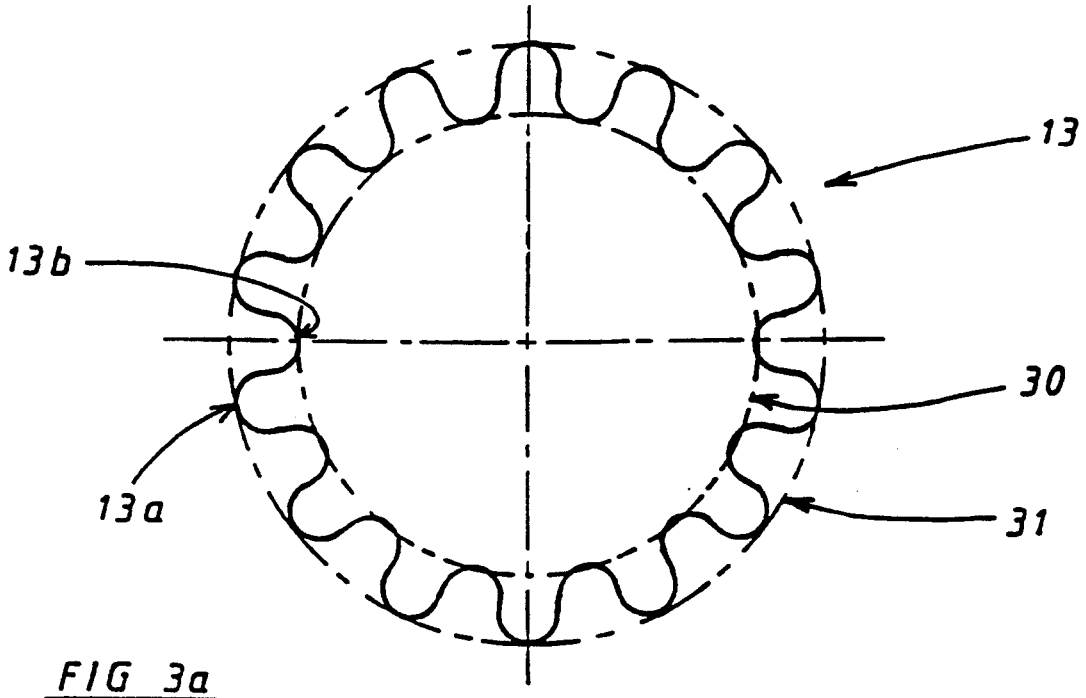
FIGS. 3*a*, 3*b*, and 3*c* depict, in two orthogonal views and in perspective, a braking means used in a first embodiment of the invention.
Figure 3B:
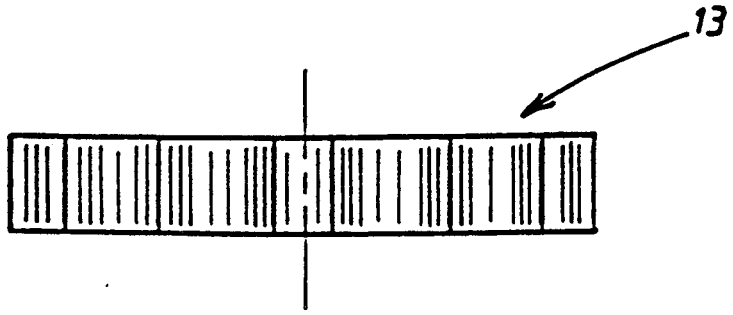
Figure 3C:
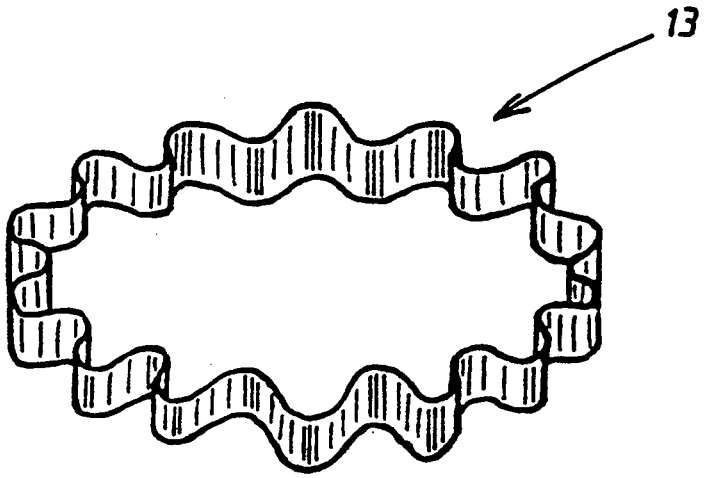

The flexible strip 13 is visible in detail in FIGS. 3*a*, 3*b*, and 3*c*. It is a spring steel strip with a thickness on the order of a few tenths of a millimeter, having the shape of a closed ring and having undulations 13*a*, 13*b* in a regular angular distribution between an inner circle 30 and an outer circle 31. The strip is produced by shaping a ring of spring steel on a special tool having the undulations.

The diameter of inner circle 30 is selected to be substantially (within a few tenths of a millimeter) equal to the diameter at the bottom of groove 29*a*; strip 13 is installed in its groove 29*a* by elastic deformation.

The diameter of outer circle 31 is selected so that once installed in peripheral groove 29*a*, undulations 13*a* emerge from groove 29*a*. Thus, strip 13 projects relative to the outside diameter of element 8*c*, and undulations 13*a* come into contact with the inside surface of shell casing 2.

The dimensions of the strip are to be adapted depending on the desired frictional force between strip and casing; in practice, dimensions should be chosen which yield a shrinkage of five to six tenths of a millimeter between the strip and the shell casing.

The device operates as follows: In flight, at the time programmed before firing, fuze 6 causes ignition of pyrotechnic composition 7. The gas pressure is exerted inside cavity 12, and abruptly pushes piston 11 against stop surface 19 present on locking collar 14. The shock is attenuated by deformable annular spring ring 20.

As it moves, the piston also pushes the moving assemblage against the base and causes shearing of the screw thread attaching the latter to the shell casing.

This ejects the base. However, the moving assemblage is not ejected behind it, since the braking means placed on payload element 8*c* retain the moving assemblage with respect to the casing.

The gases exert their pressure on pusher plate 10 through orifice 22. The latter cannot be blocked by debris from the pyrotechnic composition housing, since radial furrows 23 allow gas to pass under all circumstances.

This pressure is exerted progressively on the pusher plate, which causes slow displacement of the moving assemblage (on the order of a few meters/second compared with 15–20 m/s for initial displacement of the piston). No shock or jerking occurs between the constituent elements of the moving assembly because of the presence of keys 9. When munition 8*c* has completely emerged from casing 2, the keys are ejected radially by centrifugal force, and element 8*c* thus separates completely from the remainder of the moving assemblage.

Element 8*b* is then ejected, then element 8*a*. Emergence of the payload elements at reduced velocity ensures that they are properly dispersed on the ground, and prevents any interference among them while in flight.

The first element is highly braked immediately after ejection due to the difference in aerodynamic drag between it and the carrier shell. It therefore does not interfere with the subsequent payload element which is still attached to the moving assemblage and is released by the carrier shell only a few tens of meters farther on.

It is also possible to place braking means on the other payload elements.

By adjusting the frictional force values exerted by each braking means on the casing, it is possible to omit the provision of axial attachment means (such as keys) between the various payload elements.

Figure 6:
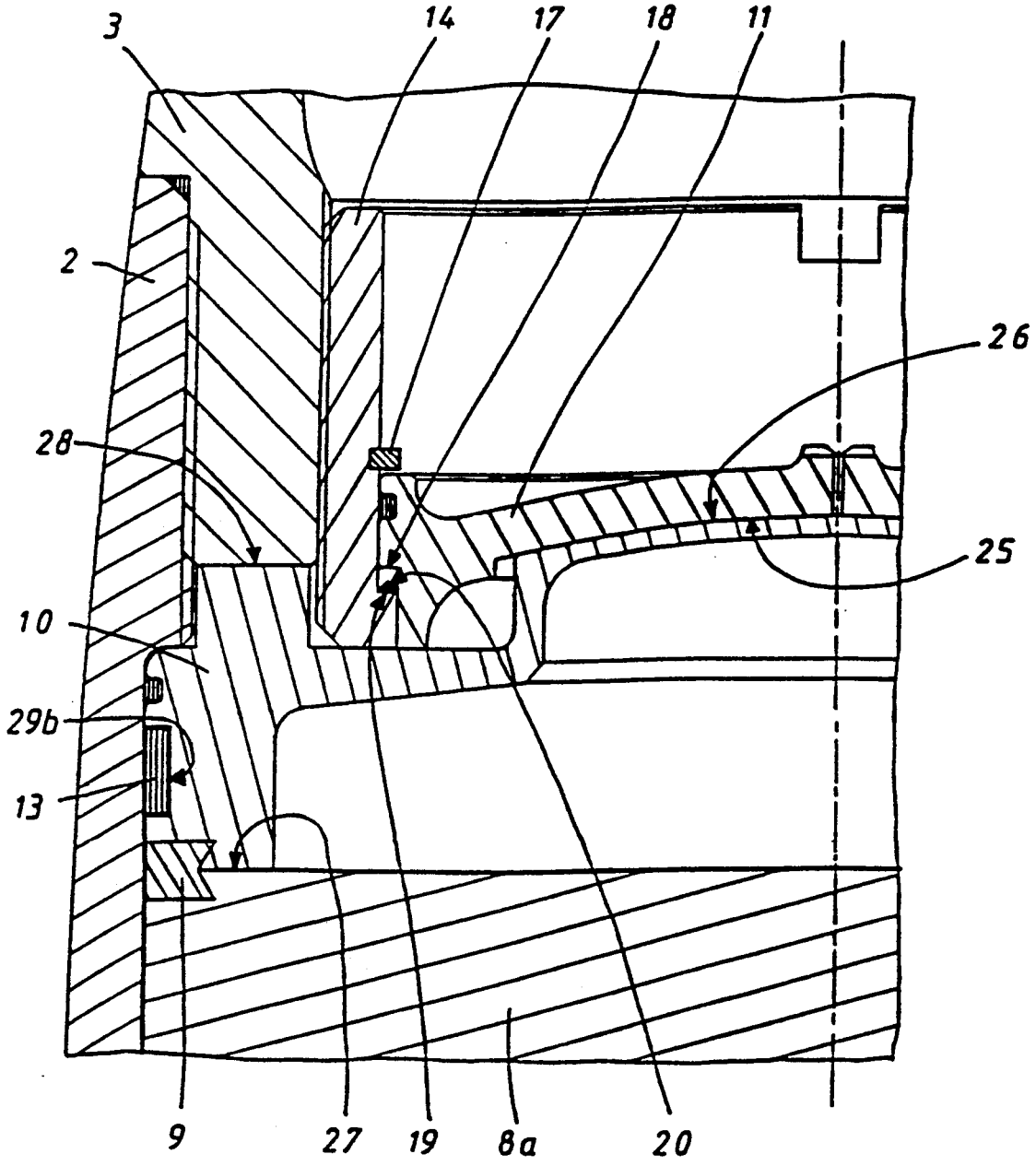
FIG. 6 is a partial, enlarged view of the ejection device according to a variant embodiment.

FIG. 6 shows a variant embodiment in which flexible strip 13 is placed in a groove 29*b* provided in pusher plate 10. For this purpose, the pusher plate has a height slightly greater than that of the plate used in the context of the preceding variant.

In this case, no flexible strip is placed on payload element 8*c*.

Aside from the presence of strip 13 on the plate 10 and the absence of a strip on element 8*c*, all the other design details are identical to those described previously, and the numerical references used are also the same.

As with the preceding variant, this arrangement is capable of preventing ejection of the entire moving assemblage after the base.

In addition, it is capable of continuously controlling the ejection velocity of the payload elements, since the braking means are active during the entire dispersion phase and not just during ejection of the first payload element.

By integrating the moving assemblage, keys 9 make it possible to place braking means only on the pusher plate to provide braking for the entire assemblage with respect to the shell casing.

It would be possible to define other variants of the invention in which the braking means would be placed on two or three payload elements as well as possibly on the pusher plate.

We claim:

1. A device for ejecting payload elements, comprising:

a piston for displacing toward a base of a carrier shell a movable assemblage comprising a pusher plate and at least one payload element, and for ejecting said base, said piston having an orifice therethrough;

a pyrotechnic composition for creating, after ignition, a gas pressure which pushes said piston over a short distance to displace said movable assemblage toward said base, said orifice being configured to allow gases resulting from ignition of said pyrotechnic composition to pass toward and push said movable assemblage; and braking means coupled to said pusher plate for braking movement of said movable assemblage relative to a casing in an amount sufficient to prevent ejection of the entire movable assemblage upon ejection of the base and to control ejection velocity of the payload elements.

2. A carrier shell, comprising:

a casing;

a head at one end of said casing;

a base at an opposite end of said casing;

a pusher plate within said casing for pushing a plurality of payload elements;

a piston within said casing for pushing toward said base said pusher plate and said payload elements and for ejecting said base, said piston having an orifice therethrough and a peripheral shoulder;

a pyrotechnic composition for creating, after ignition, a gas pressure which pushes said piston over a short distance to push said pusher plate and said payload elements toward said base, said orifice being configured to allow gases resulting from ignition of said pyrotechnic composition to pass toward and push said pusher plate and said payload elements;

stop means disposed for contacting the peripheral shoulder of the piston for stopping said piston upon ejection of said base; and braking means disposed between said shell casing and said pusher plate for braking movement of said pusher plate relative to said casing in an amount sufficient to prevent ejection of the entire movable assemblage upon ejection of the base and to control ejection velocity of the payload elements.

3. A carrier shell according to claim 2, further comprising an axial attachment inside the casing between the pusher plate and the payload elements.

4. A carrier shell according to claim 3, wherein said axial attachment comprises at least one key having a profile that interacts with complementary profiles provided on the pusher plate and the payload elements, said key also providing for said pusher plate and said payload elements to rotate together.

5. A carrier shell according to claim 2, wherein the pusher plate has a contact surface for contacting a part of the piston, said contact surface being located in a vicinity of an axis of the piston.

6. A carrier shell according to claim 2, wherein said peripheral shoulder comes to rest against a stop surface of the stop means and a deformable annular spring ring is located between the peripheral shoulder and the stop surface.

7. A device according to claim 2, wherein the braking means comprises at least one strip of flexible material placed in a peripheral groove provided on the pusher plate, said at least one strip having undulations whose amplitude is such that the undulations project from the groove so as to contact an inside surface of a casing of the carrier shell.

8. A device for ejecting a plurality of payload elements from a carrier shell which comprises a head, a casing and a base, said device comprising:

a piston for displacing toward a base of a carrier shell a movable assemblage comprising a pusher plate and payload elements, and ejecting said base, said piston having an orifice therethrough;

a pyrotechnic composition for creating, after ignition, a gas pressure which pushes said piston over a short distance to displace said movable assemblage toward said base, said orifice being configured to allow gases resulting from ignition of said pyrotechnic composition to pass toward and push said movable assemblage; and braking means for braking movement of said movable assemblage relative to said casing, wherein the braking means comprises at least one strip of flexible material placed in a peripheral groove provided on one member selected from the group consisting of said payload elements and said pusher plate, said strip having undulations whose amplitude is such that they project from the groove so as to contact an inside surface of the casing of the carrier shell.

9. A device for ejecting a plurality of payload elements from a carrier shell which comprises a head, a casing and a base, said device comprising:

a piston for displacing toward a base of a carrier shell a movable assemblage comprising a pusher plate and payload elements, and ejecting said base, said piston having an orifice therethrough;

a pyrotechnic composition for creating, after ignition, a gas pressure which pushes said piston over a short distance to displace said movable assemblage toward said base, said orifice being configured to allow gases resulting from ignition of said pyrotechnic composition to pass toward and push said movable assemblage; and braking means for braking movement of said movable assemblage relative to said casing, and being provided on one member selected from the group consisting of said payload elements and said pusher plate wherein the orifice is placed substantially on an axis of the piston, and opens on a side of the piston adjacent to the pyrotechnic composition, at a protrusion having radial channels which communicate with the orifice.

10. A device for ejecting payload elements, comprising:

a piston for displacing toward a base of a carrier shell a movable assemblage comprising a pusher plate and at least one payload element, and for ejecting said base, said piston having an orifice therethrough;

a pyrotechnic composition for creating, after ignition, a gas pressure which pushes said piston over a short distance to displace said movable assemblage toward said base, said orifice being configured to allow gases resulting from ignition of said pyrotechnic composition to pass toward and push said movable assemblage; and braking means coupled to at least one payload element for braking movement of said movable assemblage relative to a casing.

11. A device according to claim 10, wherein said at least one payload element coupled to said braking means is a payload element closest to the base.

12. A carrier shell, comprising:

a casing;

a head at one end of said casing;

a base at an opposite end of said casing;

a pusher plate within said casing for pushing a plurality of payload elements;

a piston within said casing for pushing toward said base said pusher plate and said payload elements and for ejecting said base, said piston having an orifice therethrough and a peripheral shoulder;

a pyrotechnic composition for creating, after ignition, a gas pressure which pushes said piston over a short distance to push said pusher plate and said payload elements toward said base, said orifice being configured to allow gases resulting from ignition of said pyrotechnic composition to pass toward and push said pusher plate and said payload elements;

stop means disposed for contacting the peripheral shoulder of the piston for stopping said piston upon ejection of said base; and braking means disposed between said shell casing and at least one of said payload elements for braking movement of said at least one payload element relative to said casing.

13. A carrier shell according to claim 12, further comprising an axial attachment inside the casing between the pusher plate and the payload elements.

14. A carrier shell according to claim 13, wherein said axial attachment comprises at least one key having a profile that interacts with complementary profiles provided on the pusher plate and the payload elements, said key also providing for said pusher plate and said payload elements to rotate together.

15. A carrier shell according to claim 12, wherein the pusher plate has a contact surface for contacting a part of the piston, said contact surface being located in a vicinity of an axis of the piston.

16. A carrier shell according to claim 12, wherein said peripheral shoulder comes to rest against a stop surface of the stop means and a deformable annular spring ring is located between the peripheral shoulder and the stop surface.

* * * * *